US006669518B2

(12) United States Patent
Kapsner et al.

(10) Patent No.: US 6,669,518 B2
(45) Date of Patent: Dec. 30, 2003

(54) DEVICE AND METHOD FOR HANDLING A BOAT GIMBAL HOUSING

(75) Inventors: Kevin John Kapsner, Little Falls, MN (US); Gregory Herman Rohr, Little Falls, MN (US)

(73) Assignee: Larson/Glastron Boats, Inc., Minneapolis, MN (US)

( * ) Notice: Subject to any disclaimer, the term of this patent is extended or adjusted under 35 U.S.C. 154(b) by 0 days.

(21) Appl. No.: 10/027,083

(22) Filed: Dec. 21, 2001

(65) Prior Publication Data

US 2002/0166490 A1 Nov. 14, 2002

Related U.S. Application Data

(60) Provisional application No. 60/257,699, filed on Dec. 21, 2000.

(51) Int. Cl.[7] ..... B63H 19/00

(52) U.S. Cl. ..... 440/113; 114/65 R

(58) Field of Search ..... 440/113; 114/65 R

(56) References Cited

U.S. PATENT DOCUMENTS 4,634,389 A * 1/1987 Eptaminitakis ..... 440/53
4,654,012 A * 3/1987 Bliss ..... 440/53

* cited by examiner

*Primary Examiner*—Jesus D. Sotelo
(74) *Attorney, Agent, or Firm*—Merchant & Gould P.C.

(57) ABSTRACT

A device for handling a boat gimbal housing. The device includes an upright member having an upper end and a lower end. A cross-member is connected to the upright member adjacent the upper end. A counterweight is connected to the cross-member, and a lift connection location is positioned at the cross-member between the counterweight and the upright member. A clamp mounting structure is connected to the upright member adjacent the lower end. A clamp is provided for clamping the gimbal housing. The clamp is connected to the clamp mounting structure and is positioned beneath the cross-member.

1 Claim, 4 Drawing Sheets

DEVICE AND METHOD FOR HANDLING A BOAT GIMBAL HOUSING

PRIORITY OF INVENTION

This application claims priority of invention under 35 U.S.C. §119(e) from U.S. Provisional application No. 60/257,699, filed Dec. 21, 2000, the disclosure of which is incorporated by reference herein.

FIELD OF THE INVENTION

The present invention relates generally to devices and methods for assembling products such as boats. More particularly, the present invention relates to devices and methods for handling boat gimbal housings.

BACKGROUND OF THE INVENTION

Conventional boat manufacturing processes are typically quite labor intensive and involve a significant amount of manual lifting and positioning of component parts. What is needed are methods and devices for improving manufacturing efficiency on a boat assembly line.

SUMMARY OF THE INVENTION

One aspect of the present invention relates to a device for handling a boat gimbal housing. The device includes an upright member having an upper end and a lower end. A cross-member is connected to the upright member adjacent the upper end. A counterweight is connected to the cross-member, and a lift connection location is positioned at the cross-member between the counterweight and the upright member. A clamp mounting structure is connected to the upright member adjacent the lower end. A clamp is provided for clamping the gimbal housing. The clamp is connected to the clamp mounting structure and is positioned beneath the cross-member.

Another aspect of the present invention relates to a method for mounting a gimbal housing to a boat. The method includes providing a clamp including a moveable upper clamp member and a fixed lower clamp member. The method also includes inserting the fixed lower clamp member within an opening defined by the gimbal housing, and then clamping the upper clamp member against a top surface of the gimbal housing. The method further includes lifting the gimbal housing with a boom and lift assembly connected to the clamp, and connecting the gimbal housing to a transom of the boat while the boom and winch assembly holds the clamped gimbal housing at a desired position relative to the transom.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

With reference now to the various drawings in which identical elements are numbered identically throughout, a description of various exemplary aspects of the present invention will now be provided.

Figure 1:
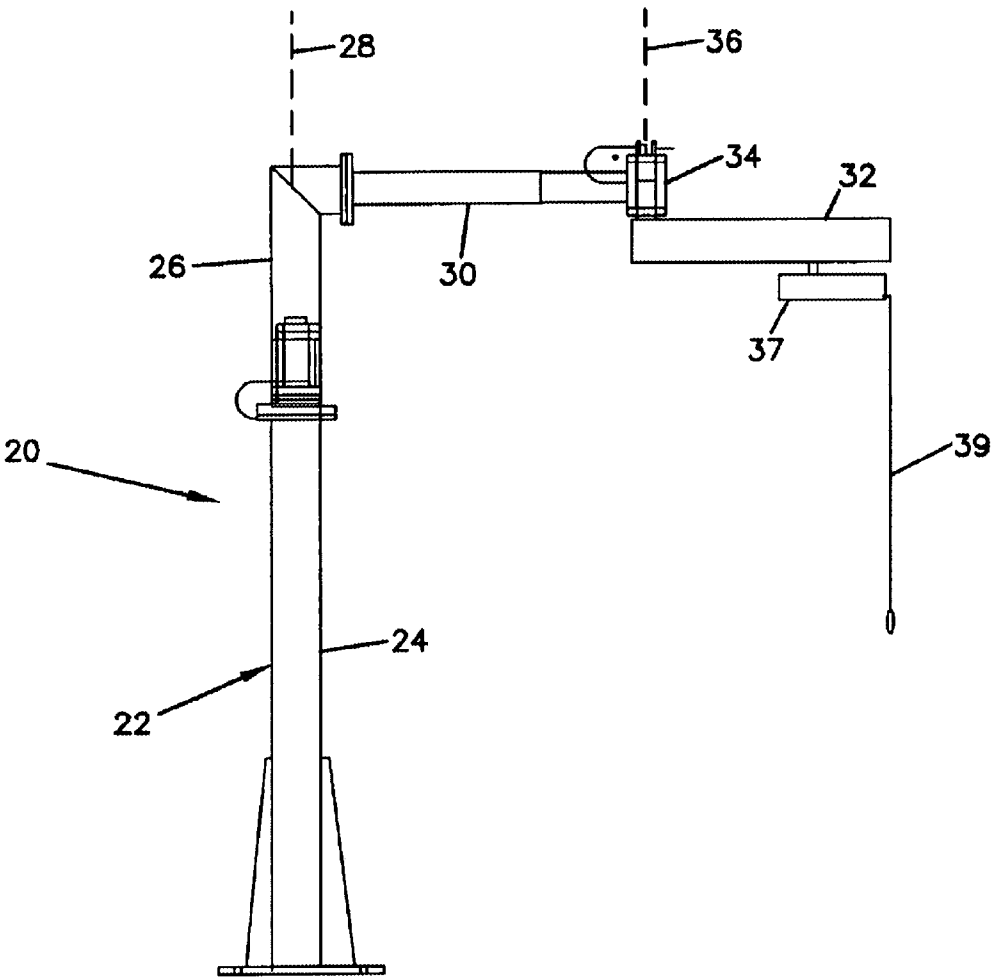
FIG. 1 is a side view of an articulated arm/boom suitable for use with an attachment constructed in accordance with the principles of the present invention.

FIG. 1 shows an articulated boom 20 (i.e., a jib or crane) suitable for use with a gimbal housing handling attachment constructed in accordance with the principles of the present invention. The articulated boom 20 includes a main post 22 having a base piece 24 and an upper extension 26. The upper extension 26 is free to pivot about a vertical axis 28 that extends longitudinally through the main post 22. A first arm 30 projects outwardly from the upper extension 26 in a cantilevered fashion. The far end of the first arm 30 is connected to a second arm 32 by a pivot mount 34. The pivot mount 34 allows the second arm 32 to pivot relative to the first arm 30 about a vertical axis 36. A lift 37 (i.e., a winch-like structure) for raising and lowering a flexible member 39 (e.g., a cable, rope, chain, etc.) is mounted on the second arm 32. It will be appreciated that articulated booms as described above are conventionally known in the art. For example, similar booms are manufactured and sold by GCI Company of Garfield, Minn. Additionally, lifts as described above are also known in the art. For example, a preferred lift is an air hoist sold under the name Bal-Trol by Tri-Motion Industries, of Tampa, Fla.

Figure 2:
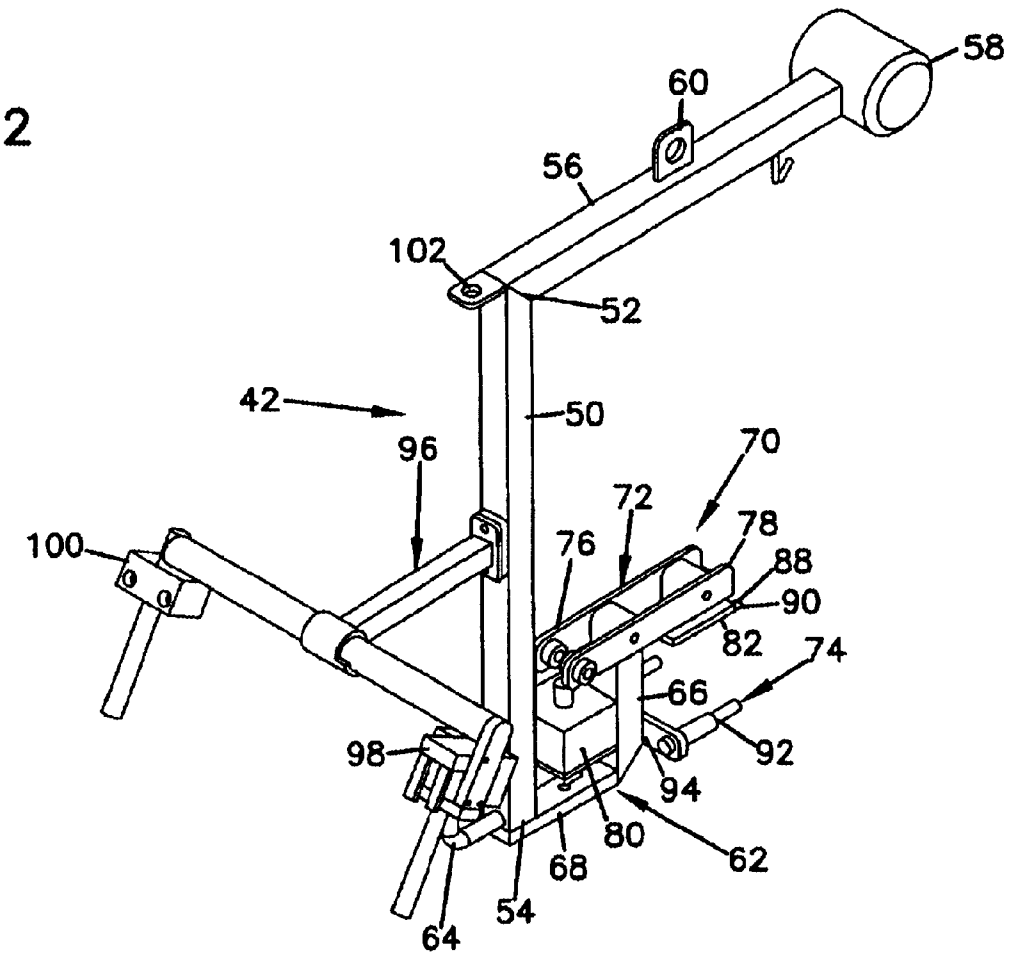
FIG. 2 is a perspective view of an articulated boom attachment constructed in accordance with the principles of the present invention.

A gimbal housing handling attachment 42 constructed in accordance with the principles of the present invention is preferably connected to the lower end of the flexible member 39. It will be understood that the phrase "connected to" includes direct connections as well as connections made by intermediate pieces or structures. FIG. 2 shows the entire handling attachment 42, while FIGS. 3A–3C show only a frame 43 of the handling attachment 42.

Figure 3A:
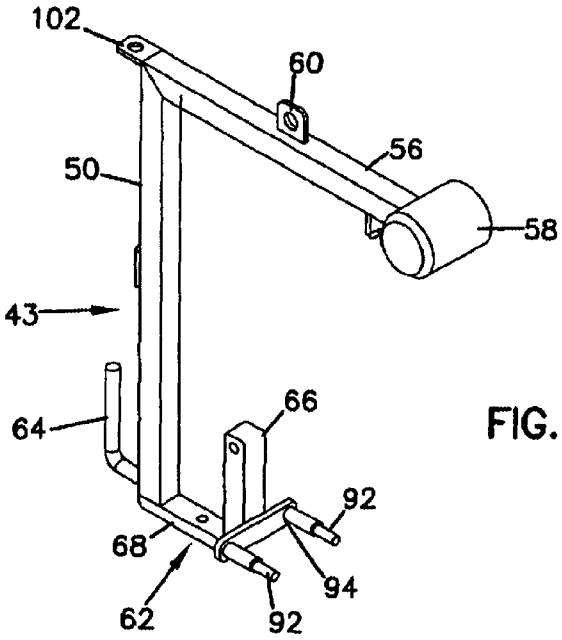
FIG. 3A is a perspective view of the frame of the attachment of FIG. 2.
Figure 3B:
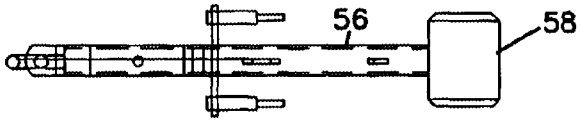
FIG. 3B is a top view of the frame of FIG. 3A.
Figure 3C:
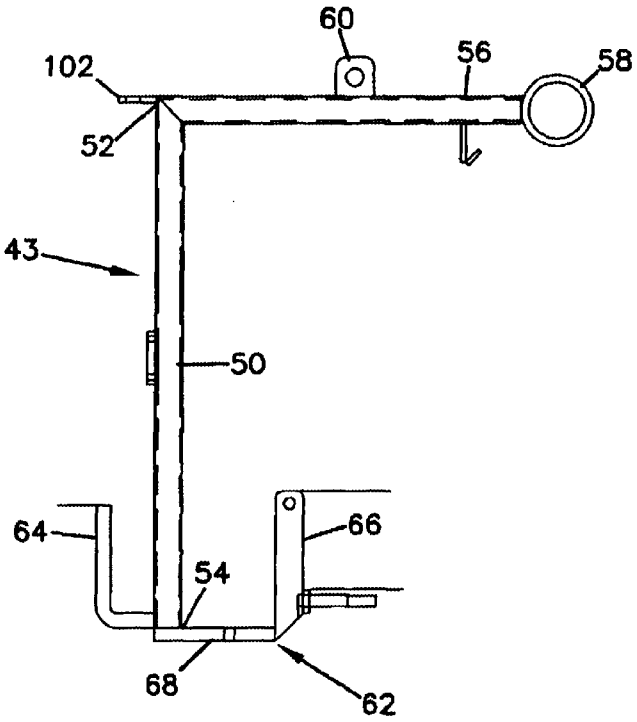
FIG. 3C is a side view of the frame of FIG. 3A.

Referring to FIGS. 3A–3C, the frame 43 includes a vertical upright member 50 having an upper end 52 and a lower end 54. It will be understood that the term "upright member" includes members or structures having greater vertical components than horizontal components. A cross-member 56 is connected to the upright member 50 adjacent the upper end 52 of the upright member 50. It will be understood that the term "cross-member" includes members or structures having greater horizontal components than vertical components. A counterweight 58 connected to a free end (i.e., the end opposite from the upright member 50) of the cross-member 56. A lift connection location 60 (e.g., an eye, loop, hook, flange, opening, etc.) is positioned at the cross-member 56 between the counterweight 58 and the upright member 50. The frame 43 further includes a clamp mounting structure 62 and a lower handle 64 connected to the upright member 50 adjacent the lower end 54. The mounting structure 62 includes a bracket having an upright leg 66 spaced from the upright member 50, and a cross-leg 68 that extends between the upright leg 66 and the upright member 50.

Referring to FIG. 2, a clamp 70 is connected to the clamp mounting structure 62. Preferably, the clamp mounting structure 62 projects outward from the upright member 50 in the same direction as the cross-member 56 such that the clamp 70 is located beneath the cross-member 56. The clamp 70 includes an upper clamp member 72 and a lower clamp member 74. The upper clamp member 72 includes first and second ends 76 and 78, and the upright leg 66 is pivotally connected to the upper clamp member 72 at a location between the first and second ends 76 and 78. A cylinder 80 (e.g., a pneumatic cylinder) is provided for pivoting the upper clamp member 72 to clamp or unclamp the clamp. The cylinder 80 is mounted on the cross-leg 68 between the upright leg 66 and the upright member 50, and the cylinder 80 is connected to the upper clamp member 72 at a location adjacent the first end 76 of the upper clamp member 72. The upper clamp member 72 also includes a clamping pad 82 positioned adjacent the second end 78 of the upper clamp member 72. The pad 82 includes a reinforcing portion 88 made of metal, and a cushioning portion 90 made of a resilient material such as rubber.

The lower clamping member 74 includes two clamping pins 92 that project outwardly from the upright leg 66 and extend beneath the clamping pad 82. The clamping pins 92 are held in spaced-apart relation relative to one another by a spacer member 94 that is fixedly connected (e.g., welded or fastened with one or more fasteners such as bolts) to the upright leg 66. The pins 92 are spaced apart a distance corresponding to an opening in the gimbal housing desired to be handled. In some embodiments, the spacing between the pins 92 can be varied to accommodate different gimbal housings. Preferably, the pins 92 are aligned along a common horizontal plane.

The attachment 42 also includes an upper handle 96 connected to an intermediate location of the upright member 50. The handle 96 projects outward from the upright member 50 in a direction opposite from the cross-member 56. A first control 98 for raising and lowering the flexible member 39 with the lift 37 is provided on the handle 96. A second control 100 for controlling the cylinder 80 to open and close the clamp 70 is also provided on the handle 96. The controls 98 and 100 preferably include conventional valving for controlling air pressure provided to the lift 37 and the cylinder 80 from a source of compressed air (e.g., a compressor). Air hoses (not shown) are preferably used to provide fluid communication between compressor and the controls 98 and 100, and to also provide fluid communication between the controls 98 and 100 and the lift 37 and the cylinder 80, respectively. One or more mounts 102 can be provided on the frame for use in managing/securing the hoses.

Figure 4:
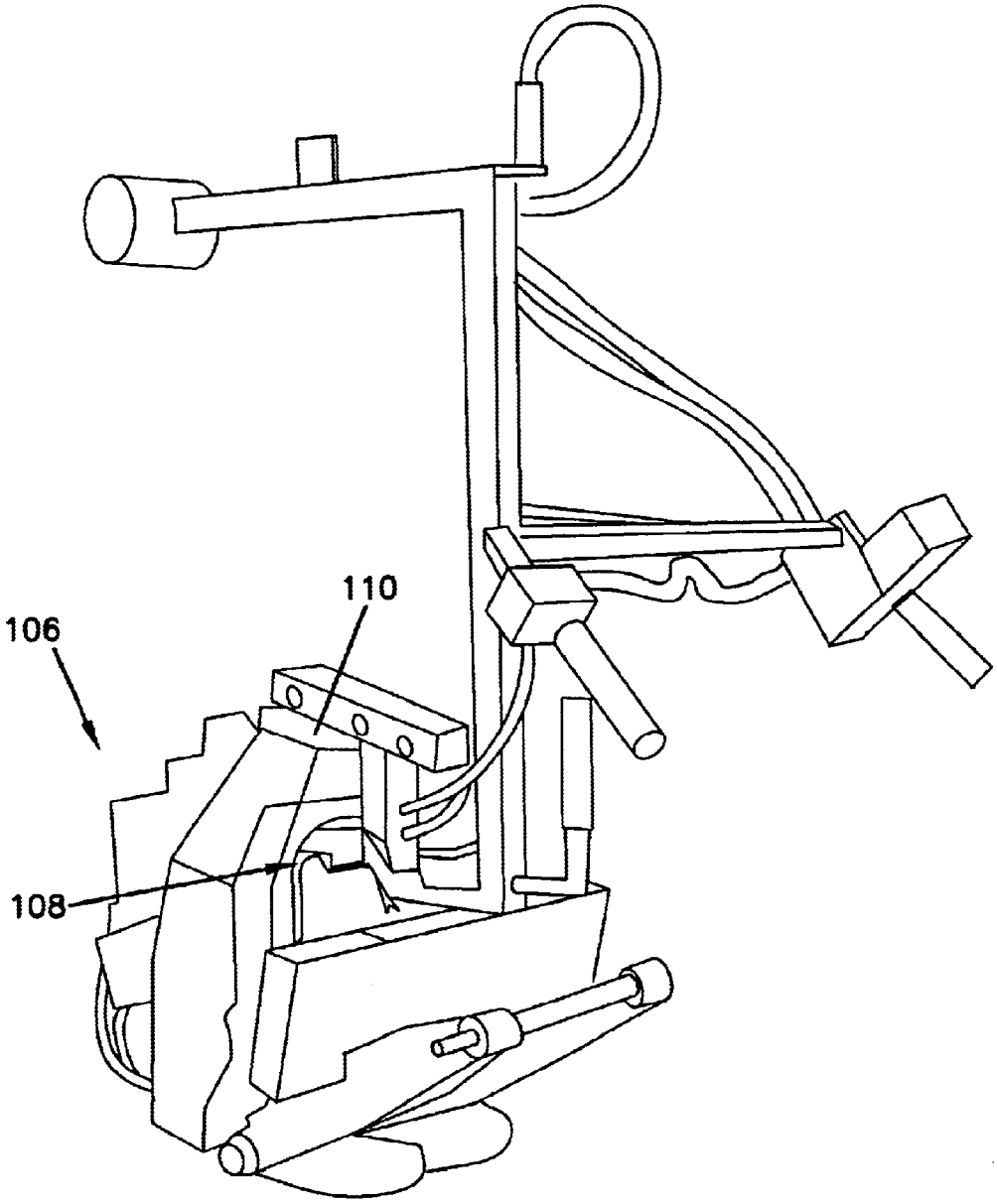
FIG. 4 is a perspective view of the attachment of FIG. 2 clamped on a gimbal housing for a boat.

FIG. 4 shows a boat gimbal housing 106 that is an example of the type structure the attachment 42 is adapted for handling. The gimbal housing 106 includes an outer metal casing that houses components for allowing a shaft of a boat motor to tilt up and down, and also for allowing the shaft to pivot back and forth for turning the boat. The gimbal housing 106 is preferably secured to the transom of the boat.

To connect the gimbal housing 106 to the transom, the clamping pins 92 are inserted in an opening 108 defined by the gimbal housing 106 (see FIG. 4). With the pins 92 so inserted, the upper clamp member 72 is clamped down on an upper surface 110 of the gimbal housing 106. The lift 37 is then used to lift the clamped gimbal housing 106 to a desired elevation, and the gimbal housing 106 is manually moved to a location adjacent the transom of the boat. As the gimbal housing 106 is moved, the arms of the articulated boom 20 pivot relative to one another to accommodate the movement. Once positioned adjacent the transom, the gimbal housing is connected (e.g., by fasteners such as bolts) to a transom of the boat. During the connection process, the boom and lift assembly holds the clamped gimbal housing at the desired position relative to the transom.

The above specification and examples provide a complete description of the manufacture and use of the composition of the invention. While a preferred use of the disclosed device is for handling gimbal housings of boats, it will be appreciated that articles and manufacturing components could also be handled with the device. Since many embodiments of the invention can be made without departing from the spirit and scope of the invention, the invention resides in the claims hereinafter appended.

What is claimed is:

1. A method for mounting a gimbal housing to a boat, the method comprising:

providing a clamp;

clamping the clamp against the gimbal housing;

lifting the gimbal housing with a boom and lift assembly connected to the clamp;

using the boom and lift assembly to position the gimbal housing adjacent to a transom of a boat; and connecting the gimbal housing to the transom of the boat while the boom and lift assembly holds the clamped gimbal housing elevated at a desired position relative to the transom.

* * * * *